United States Patent [19]

Walker

[11] Patent Number: 4,509,777

[45] Date of Patent: Apr. 9, 1985

[54] WELD-ON CASING CONNECTOR

[75] Inventor: James M. Walker, Houston, Tex.

[73] Assignee: Dril-Quip Inc., Houston, Tex.

[21] Appl. No.: 438,574

[22] Filed: Nov. 1, 1982

[51] Int. Cl.[3] ..... F16L 13/04

[52] U.S. Cl. ..... 285/286; 285/114; 285/334

[58] Field of Search ..... 285/286, 333, 334, 390, 285/355, 114; 403/41, 343

[56] References Cited

U.S. PATENT DOCUMENTS

| | | | |
|---|---|---|---|
| 1,960,557 | 5/1934 | Snyder | 285/286 X |
| 2,205,697 | 6/1940 | Scharpenberg | 285/333 X |
| 2,216,945 | 10/1940 | Hinderliter | 285/114 |
| 2,676,820 | 4/1954 | Boile | 285/114 |
| 3,388,752 | 6/1968 | Hanes et al. | 285/334 X |

*Primary Examiner*—Dave W. Arola
*Attorney, Agent, or Firm*—Vaden, Eickenroht, Thompson & Jamison

[57] ABSTRACT

A weld-on female casing connector is disclosed having an upper threaded section and a lower cylindrical section that is welded to the casing. Located between the two sections is a connecting section that has a downwardly decreasing cross-sectional area until the cross-sectional area approaches the cross-sectional area of an ideal transition section and has a stress in the range of other high stress sections of the connector than an increasing cross-sectional area until the outside diameter of the connecting section is sufficient to provide a downwardly facing elevator shoulder of sufficient area to support the casing on an elevator.

6 Claims, 4 Drawing Figures

WELD-ON CASING CONNECTOR

This invention relates to casing connectors for large diameter casing used in drilling operations.

In many drilling operations, and particularly in offshore drilling operations, large diameter casing strings are run and set in the well bore during the early stages of the drilling operation. Rather than thread these large diameter joints of casing, it is common practice to weld a threaded connection to each end. The connector on the upper end of the casing will have internal threads to provide the female or box portion of the connection and the connector attached to the lower end of the casing will have external threads to provide the male or pin portion of the connection. With the connectors so attached, the individual joints of casing can be quickly and easily screwed together and lowered into the well bore as a casing string in the conventional manner.

These large diameter casing string are heavy and the casing connectors are subjected to substantial tensile forces. Where the casing string is being lowered through water offshore, currents can cause the connectors to be subjected to bending moment. They also can be subjected to serve bending moment when the casing string is being run through the water and the drilling rig platform is not properly aligned over the well bore into which the casing is being run.

Elevators are used to handle the casing string when it is being made up and lowered into the well bore, and since elevators for large diameter pipe were usually of the collar type, i.e. of the type that engages the lower end of a collar on a conventional threaded and collared casing string, the weld-on casing connectors are provided with a shoulder to be engaged by a collar type elevator. Previously, this shoulder was formed in the body of the connector box just above the lower cylindrical section of the connector that is welded to the casing and extends outwardly to the outside diameter of the connector. This results in a very large discontinuity in the cross-sectional area of the connector and results in high stress risers in the lower cylindrical section adjacent the discontinuity when the connector is subjected to tensile forces and bending forces.

It is an object of this invention to provide a female casing connector that reduces substantially the cross-sectional discontinuities of the connector, thereby reducing the amount of any stress risers that may be produced in the connector when subjected to a tensile or bending force.

It is another object of this invention to provide a female casing connector with a section that connects the lower cylindrical section to the upper threaded section that has an outside surface that decreases in cross-sectional area at approximately the rate of an ideal transition section for about one-third to one-half the distance to the lower cylindrical section after which it increases in cross-sectional area sufficiently to provide an elevator shoulder having an area adequate to support the casing on elevators to provide a connecting section that reduces the stress in the cylindrical section in the plane of the elevator shoulder for a given tensile load on the connector.

It is a further object of this invention to provide the box or female portion of a casing connector with a connecting section located between the threaded section of the connector and the cylindrical section welded to the casing that has a gradually decreasing cross-sectional area downwardly in the direction of the cylindrical section attached to the casing until the cross-sectional area of the section is about equal to the cross-sectional area of an ideal transition section and the stress in the section is in the range of the stress in other high stress sections of the connector when the connector is subjected to a tensile load and thereafter, the connecting section has a gradually increasing cross-sectional area until it reaches a diameter that will provide a minimum collar for supporting the casing on a shoulder type elevator to thereby reduce to a minimum the drastic change in cross-sectional area at the elevator shoulder, which results in a significantly reduced maximum stress in the cylindrical section adjacent the elevator shoulder.

These and other objects, advantages and features of this invention will be apparent to those skilled in the art from a consideration of this specification including the attached drawings and appended claims.

Figure 3:
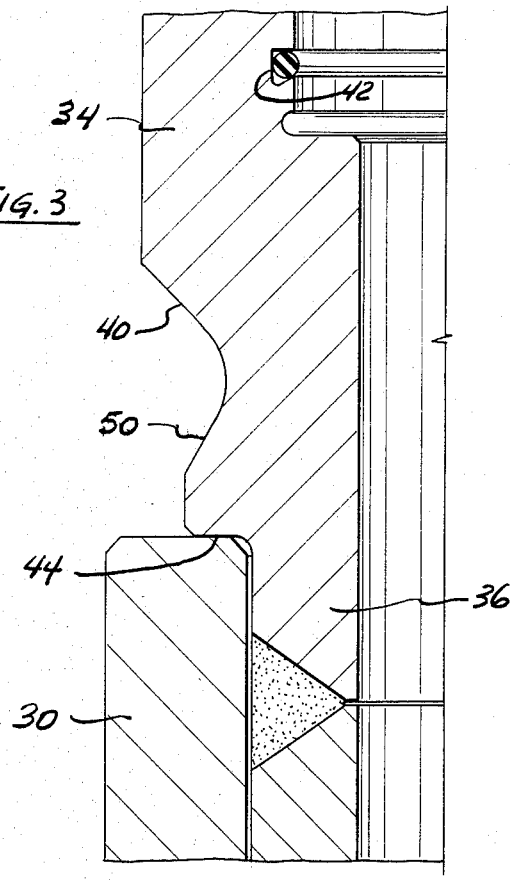
Figure 4:
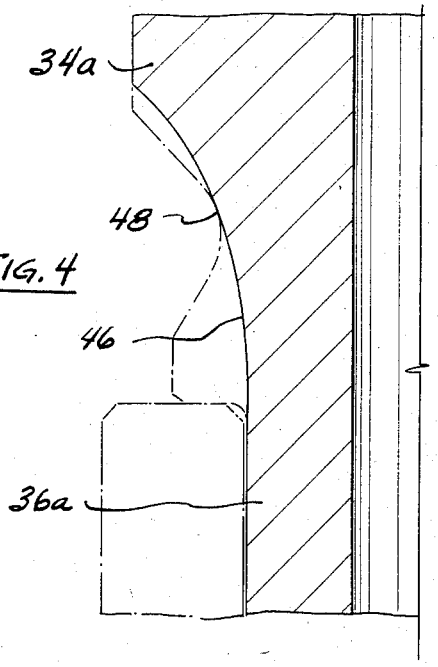

FIG. 3 is a view on an enlarged scale of the section of the casing connector box of this invention that connects the upper threaded section with the lower cylindrical section that is welded to the casing; and FIG. 4 is a view of the ideal transition section with the contour of the preferred embodiment of the connecting section of this invention and the elevator in engagement with the elevator shoulder provided by the connecting section shown in dotted lines.

Figure 2:
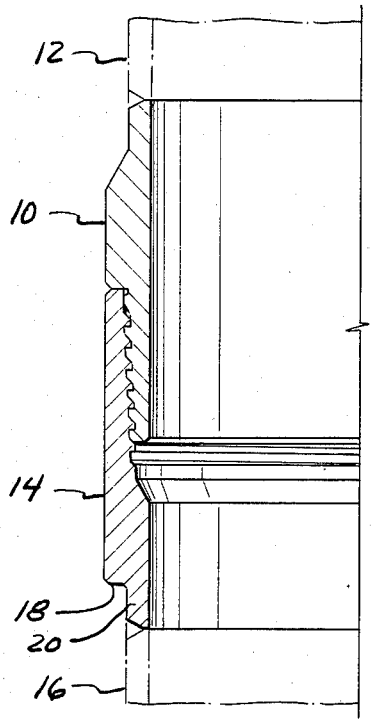
FIG. 2 PRIOR ART
FIG. 2 is a cross section through a typical prior art casing connector.

As explained above, casing connectors include female or box connectors and male or pin connectors. A typical prior art pin and box connector is shown in FIG. 2. Pin 10 is welded at its upper end to the lower end of casing joint 12. Box 14 is connected to the upper end of casing joint 16. The connectors are designed so that the minimum inside diameter of the box and pin is about equal to the inside diameter of the casing so that the connector will not restrict the opening through the casing. This results in the outside diameter of the connectors being larger than the outside diameter of the casing. This allows elevator shoulder 18 to be provided at the lower end of box 14 by simply reducing the diameter of the box to that of the outside diameter of the casing. This is a substantial change in the cross-sectional area of the box. Such a discontinuity produces high stress risers where shoulder 18 joins cylindrical section 20 when the box is subjected to tensile forces and reduces the amount of tensile force that can be placed on the connector.

Figure 1:
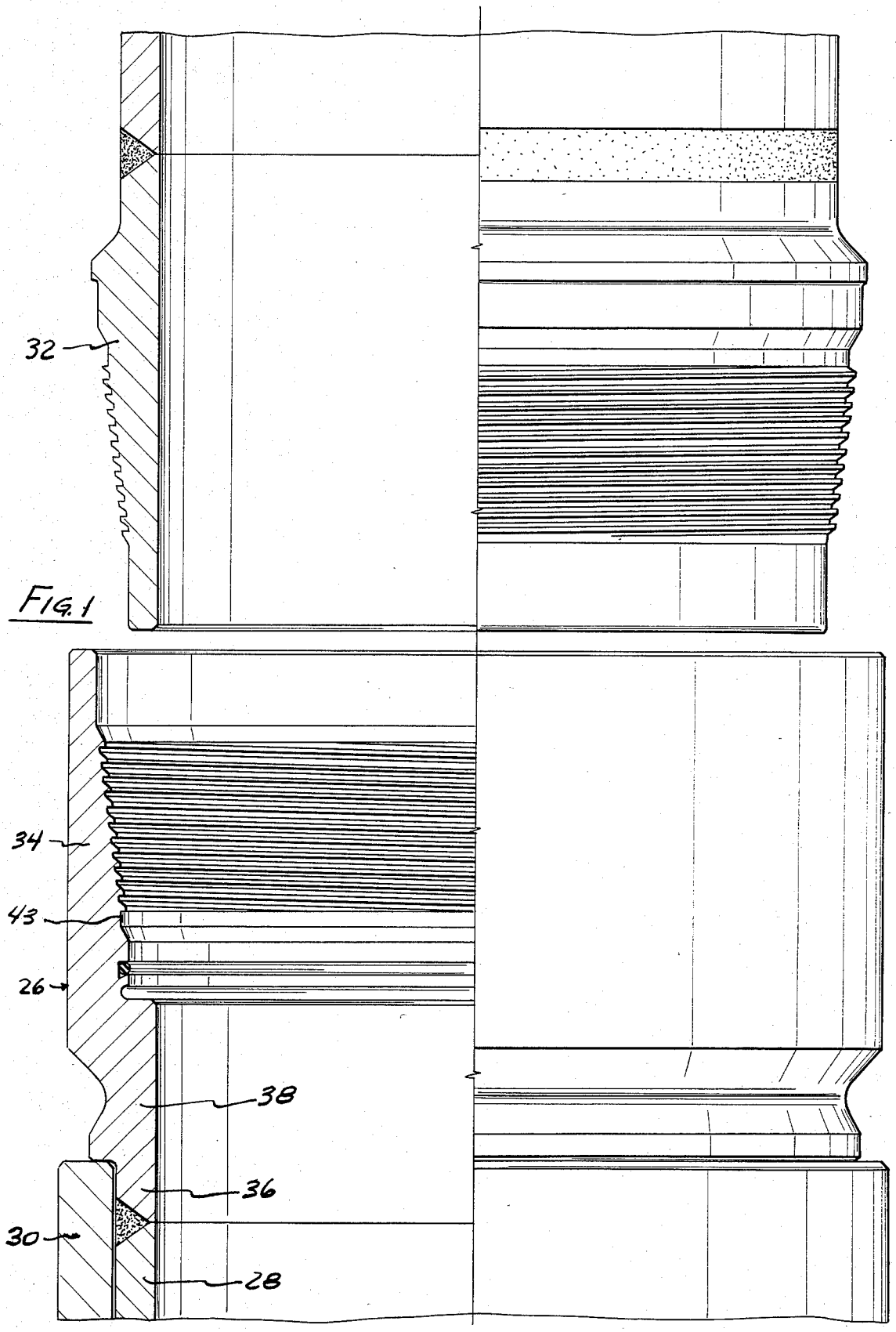
FIG. 1 is a view partly in elevation and partly in section of the preferred embodiment of the box portion of the connector resting on elevators as the pin portion is positioned to be inserted into the box and the threaded connection made up.

In FIG. 1, female or box connector 26 that incorporates the preferred embodiment of this invention is welded to casing joint 28 at its lower end and is supported on elevators 30 to be connected to pin connector 32 when the pin is lowered into the box and the threaded connection is made up in the conventional manner.

Female connector 26 includes threaded section 34 at its upper end and cylindrical section 36 at its lower end. Threaded section 34 has an inside and outside diameter substantially greater than the inside and outside diameter of casing 28 in order to accommodate the threaded portion of pin 32 without decreasing the inside diameter of the connector to something less than the inside diameter of the casing. Cylindrical section 36 on the lower end of female connector 26 has an inside and outside diameter substantially the same as the casing to allow it to be beveled for welding in the same manner that the end of casing joint 28 is beveled and a conventional butt weld can be used to connect the lower end of the connector to the casing. Connecting upper threaded section 34 and lower cylindrical section 36 is connecting or transition section 38.

In accordance with this invention, connecting section 38 is designed to transfer the tensile forces acting on the connector between the upper and lower sections with a minimum of large discontinuities in the cross section of the section. In FIG. 4, an ideal transition section is shown in solid line. It has a gradully decreasing cross-sectional area in the direction of cylindrical section 36*a*. This contour, however, does not provide a shoulder for the elevators used to support the pipe as the connectors are being made up and run into the well bore.

Therefore, in accordance with this invention, connecting section 38, as shown in FIG. 3, has a gradually decreasing cross-sectional area in the direction of cylindrical section 36 due to downwardly and inwardly sloping outer surface 40. The cross-sectional area is reduced until outer surface 40 intersects ideal surface 46 at point 48 at about one-third to one-half the distance toward cylindrical section 36.

The outer surface of the connecting section then curves outwardly and follows downwardly and outwardly inclined surface 50 until it reaches a diameter sufficient to provide elevator shoulder 44. The outside diameter of elevator shoulder 44 can be substantially less than the outside diameter of threaded section 34 and provide adequate bearing surface for supporting the casing on elevator 30. In this embodiment, the shoulder is about half as wide as prior art shoulders.

The outside configuration of connecting section 38 is shown in dotted lines on FIG. 4 to illustrate how the ideal configuration is approached. The upper end of connecting section 38 departs from the ideal in this embodiment simply because straight surface 40 provides a better connector lead in running profile than the curved contour of the ideal section and at this point in the connector, the structural difference is not important. The principle thing is to have the area of the connector gradually decrease in cross section until it reaches a cross-sectional area that will be stressed in the range of other high stress locations in the connector, and then gradually increase in cross-sectional area to provide an elevator shoulder having a minimum bearing area thereby keeping to a minimum discontinuities in the cross-sectional area of the connector.

A stress analysis was made of the connector of this invention and a connector of the type shown in FIG. 2. The stress in the cylindrical section at the elevator shoulder was about 11.2% less in the connector of this invention than it was in the prior art connector. This resulted in a reduction in the stress in the welded connection by about 10.6%. This is very important because the quality of welds is not uniform and the stress in this area should be kept to a minimum. The highest stress was at O-ring groove 42. The stress at the intersection of surface 40 and the ideal surface was in that range being about twenty percent lower.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

What is claimed is:

1. A weld-on female casing connector comprising a tubular body with an internally threaded section on its upper end having an outside diameter greater than the outside diameter of the casing to which it is to be connected and a minimum inside diameter substantially equal to the inside diameter of the casing to which it is to be connected and a cylindrical section at its lower end having an inside diameter and an outside diameter approximately equal to that of the casing to which the cylindrical section is to be welded, a connecting section between the threaded section and the cylindrical section that has a gradually decreasing cross-sectional area in the direction of the cylindrical section until the cross-sectional area of the section will be about equal to the cross-sectional area of an ideal transition section, said second then gradually increasing in cross-sectional area in the direction of the cylindrical section until it reaches an outside diameter that is large enough to provide sufficient bearing surface to support the casing and decreasing the cross-sectional area to form a downwardly facing shoulder having the minimum area required to support the casing on elevators to reduce the abrupt change in cross-sectional area at the shoulder to a minimum to provide a connecting section that reduces the stress in the cylindrical section in the plane of the elevator shoulder for a given tensile load.

2. The connector of claim 2 in which the portion of the connecting section having a gradually decreasing cross section toward the cylindrical section has an outer surface that approximates the outer surface of an ideal transition section and extends about one-third to one-half the length of the ideal transition section.

3. The connector of claim 1 in which the stress in the connecting section at its minimum cross-sectional area is in the range of the stress in other high stress sections of the connector.

4. The casing connector of claim 1 in which the connecting section increases in cross-sectional area until its outside diameter has increased about one-half as much as it was at its minimum cross-sectional area.

5. A weld-on female casing connector comprising a tubular body with an internally threaded section on its upper end having an outside diameter greater than the outside diameter of the casing to which it is to be connected and a minimum inside diameter substantially equal to the inside diameter of the casing to which it is to be connected and a cylindrical section at its lower end having an inside diameter and an outside diameter approximately equal to that of the casing to which the cylindrical section is to be welded, a connection section between the threaded section and the cylindrical section that has an upper portion of gradually decreasing cross-sectional area in the direction of the cylindrical section that has an outer surface contour that approximates the outer surface contour of an ideal transition section and extends about one-third to one-half the length of the ideal transition section, said connecting section then gradually increasing in cross-sectional area in the direction of the cylindrical section until it reaches an outside diameter that is large enough to provide sufficient bearing surface to support the casing and decreasing the cross-sectional area to form a downwardly facing shoulder having the minimum area required to support the casing on elevators to reduce the abrupt change in cross-sectional area at the shoulder to a minimum to provide a connection section that reduces the stress in the cylindrical section in the plane of the elevator shoulder for a given tensile load.

6. The connector of claim 5 in which the stress in the connecting section at its minimum cross-sectional area is in the range of the stress in other high stress sections of the connector.

* * * * *